US005704851A

United States Patent [19]

Lucetti

[11] Patent Number: 5,704,851

[45] Date of Patent: Jan. 6, 1998

[54] WEIGHTED PUTTER

[75] Inventor: Joseph J. Lucetti, Escondido, Calif.

[73] Assignee: Chad Emarine; a part interest

[21] Appl. No.: 692,799

[22] Filed: Jul. 30, 1996

[51] Int. Cl.[6] ..... A63B 53/04

[52] U.S. Cl. ..... 473/328

[58] Field of Search ..... 473/328, 340, 473/336, 337

[56] References Cited

U.S. PATENT DOCUMENTS

| | | | |
|---|---|---|---|
| 1,531,821 | 3/1925 | Scott | 473/328 |
| 2,472,312 | 6/1949 | Parrish | 473/328 |
| 4,332,388 | 6/1982 | Crow | 473/328 |
| 4,962,932 | 10/1990 | Anderson | 473/336 |
| 5,286,027 | 2/1994 | Koumarianos | 473/328 |
| 5,335,913 | 8/1994 | White | 473/328 X |

*Primary Examiner*—William H. Grieb

*Attorney, Agent, or Firm*—Henri J.A. Charmasson; John D. Buchaca

[57] ABSTRACT

A golf putter has a pair of rails projecting downwardly from the sole of the head and oriented in the striking direction, thus raising the center of gravity of the head to the same level as the center of gravity of the ball and the striking point on the face of the putter.

7 Claims, 1 Drawing Sheet

WEIGHTED PUTTER

FIELD OF THE INVENTION

This invention relates to sporting goods, and more particularly to golf putters.

BACKGROUND OF THE INVENTION

Improved putting accuracy is always the primary goal of a golfer. When one considers that at over 3 meters (10 feet) a directional error of only 6 degrees causes the ball to miss the cup, it is no wonder that a great deal of efforts have been spent toward improving the quality of golf putters. One improvement has been the addition of rails or runners to the sole of the putter for allowing the putter to glide over the green surface without the lower edge of the face of the putter catching on the grass or turf, as disclosed in U.S. Pat. No. 1,531,821 Scott. This improvement was carried over to other clubs such as woods as disclosed in U.S. Pat. No. 4,332,386 Crow. Spherical protrusions, rather than runners or rails, have also been used for the same purpose and for increasing the weight and kinetic energy that accumulates in the putter as disclosed in U.S. Pat. No. 5,286,027 Koumarianos. In spite of the above-described and other improvements, the prior art has not adequately addressed one of the most contributory causes to putting inaccuracy, the instability of the putter. Instability and directional error often result from oscillation or vibration of the putter at the instant it hits the ball.

It has been discovered that instability is contributed by vibration caused by a misalignment of the center of gravity of the putter itself with the striking point on the forward face of the putter with the ball. Such a mismatch causes a torquing force to develop between the center of gravity of the putter and the striking point. This force must necessarily be dissipated by a slight movement of the putter. The higher the weight of the putter head, the more significant becomes the induced vibrations to the point that a misalignment of a few millimeters can result in enough vibration to misdirect the ball by several degrees.

SUMMARY OF THE INVENTION

The principal object of this invention is to improve the stability of golf putters, and more specifically, to reduce or completely eliminate vibrations caused by the impact with the golf ball. It is another object of this invention to provide a putter that can be positioned and moved very accurately in a gliding contact with the surface of the putting green so as to align the center of gravity of the putter with its striking zone and the center of gravity of the ball for more stable and accurate putts.

These and other valuable objects are achieved by adding a pair of spacing rails projecting from the sole of the putter toward the ground surface. The spacers have a generally oblong shape with longitudinal axes in the direction of strike. Their beveled or tapered front and back ends provide for easy gliding over the grass surface. The combined center of gravity of the putter head and spacer is positioned substantially within the same plane as the equator of the ball and the striking zone on the face of the putter so as to minimize any disrupting vibration of the putter upon impact.

DESCRIPTION OF THE PREFERRED EMBODIMENT OF THE INVENTION

Figure 1:
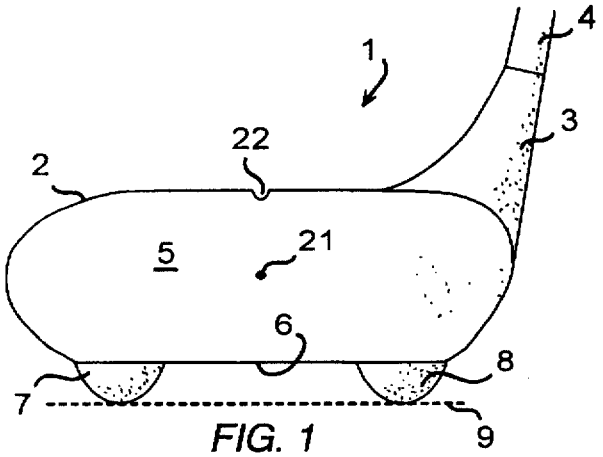
FIG. 1 is a front elevational view of a putter according to the invention.
Figure 2:
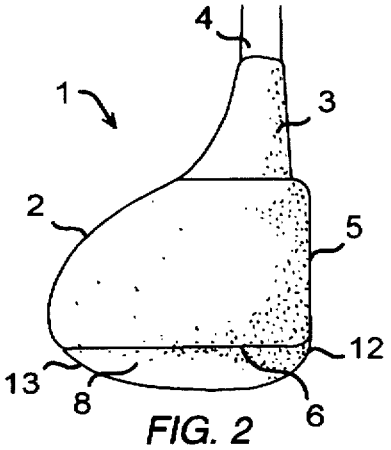
FIG. 2 is a outer side view thereof.
Figure 3:
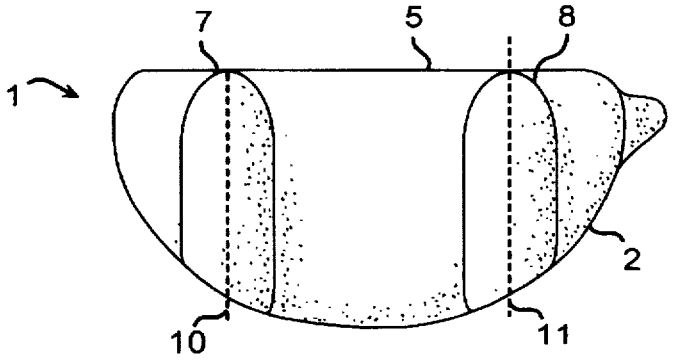
FIG. 3 is a bottom plan view thereof.

Referring now to the drawing, there is shown an improved putter I whose head 2 extends upwardly into a hosel 3 for receiving a shaft 4. The head has a flat and substantially vertical front face 5 to which may be imparted a slight left of about 5 degrees from the vertical as it is customarily done to compensate for any misalignment at the time of strike that could drive the ball toward the ground. Projecting downwardly from the undersurface 6 of the head, are two parallel and spaced apart spacers 7, 8 which extend downwardly to a ground plane 9 parallel to the undersurface and substantially perpendicular to the front face 5. The spacers 7, 8 are oblong and have their longitudinally axes perpendicular to the front face 5. The spacers have a substantially semicircular median cross-section. Their forward bottom ends taper up toward the undersurface 6, and their backward ends 13 taper up over approximately half the length of the spacers toward the undersurface 6. The rounded and tapered shape of the spacers are designed for easy gliding over the turf surface of the green while offering very little resistance to the movement of the head toward the ball.

Figure 4:
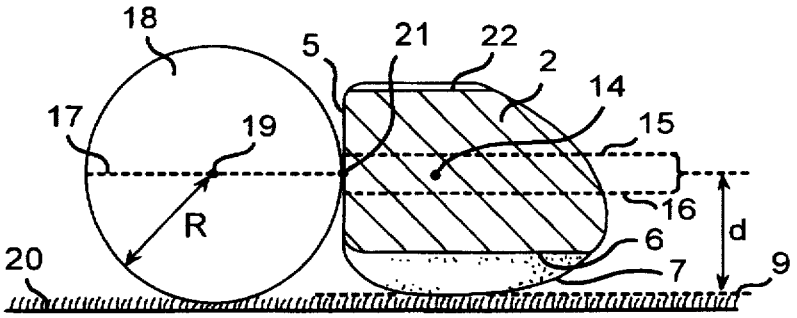
FIG. 4 is a diagram of the relative positions of the golf ball, putter head and the surface of the green at the striking time.

As more specifically illustrated in the diagram of FIG. 4, the center of gravity 14 of the combined head and spacers is positioned within a range delineated by two horizontal level planes 15, 16 within which lies also the equatorial line 17 of the ball 18 and the ball's center of gravity 19. Accordingly, the vertical distanced between the center of gravity 14 of the head and the ground plane 9 corresponding to the base of the spacers is approximately equal to the radius R of the ball. Taking into account the fact that at the striking time the ground plane 9 is slightly above the actual ground surface 20 upon which the ball rests, it has been determined that the upper limit of d constituted by the plane 15 at which the center of gravity of the head 14 can be positioned is approximately R plus 3 millimeters, and that the lower limit constituted by the lower plane 16 is R minus 9 millimeters measured from the ground plane 9.

For added stability and accuracy, it is critical that the striking point 21 on the front face of the head be also lined up horizontally with the center of gravity 14. To that purpose, a front to back groove 22 is cut into the top of the head immediately above the center of gravity in order to facilitate alignment.

The alignment of the putter head and ball center of gravity can also be achieved by appropriately distributing the weight of the head without using any spacer. In such a case the distance d is measured vertically from the lowermost point on the undersurface of the head.

It should be understood that the shape of the putter head illustrated in connection with this preferred embodiment of the invention is not critical, and that the invention can be adapted to a great variety of putter head configurations. Such adaptation may require the use of a different number of spacers. The positioning of the spacers may also have to be changed in order to position the putter in the exact desired location when it rests lightly on the ground near the ball before striking. The spacers can be made integrally of the same material as the head, and their weight can be conveniently adjusted to bring the center of gravity of the structure to the desired height. For instance, the spacers can be tubular, or made hollow initially then injected with the necessary weighting material to make such an adjustment. The cross-section of the spacer may be narrowed in order to minimize the drag against the ground surface. However, the preferred embodiment disclosed above is thought to be the best compromise between various critical factors including sturdiness, stability and ease of fabrication.

While the preferred embodiments of the invention have been described, modifications can be made and other embodiments may be devised without departing from the spirit of the invention and the scope of the appended claims.

What is claimed is:

1. A golf putter for use with a golf ball having a radius R and a center of gravity, said putter comprising a shaft and a striking head having an undersurface, and substantially vertical and flat front face;

said head further comprising at least one spacer member projecting downwardly from said under surface and extending to an horizontal ground plane, said head and spacer together having a center of gravity located within a striking plane parallel to said ground plane and spaced-apart thereof by a distance d, wherein d falls within a range extending approximately from R plus 3.0 millimeters to R minus 9.0 millimeters;

whereby when said putter strikes said golf ball resting over said ground plane, the center of gravity of the golf ball is substantially within said striking plane.

2. The putter of claim 1, wherein said at least one spacer comprises an oblong body having a longitudinal axis perpendicular to said front face.

3. The putter of claim 1, which further comprises at least two of said spacers.

4. The putter of claim 3, wherein said oblong body has a forward lower surface tapering up to said undersurface.

5. The putter of claim 4, wherein said oblong body has a substantially semi-circular median cross-section.

6. The putter of claim 4, wherein said oblong body has a lower surface tapering up over substantially half of its length toward said undersurface.

7. A golf putter for use with a golf ball having a radius R and a center of gravity, said putter comprising a shaft and a striking head comprising an undersurface having a lowermost point;

said head having a center of gravity located within a striking plane parallel to a ground plane and vertically spaced-apart from said lowermost point by a distance d, wherein d falls within a range extending approximately from R plus 3.0 millimeters to R minus 9.0 millimeters;

whereby when said putter strikes said golf ball resting over said ground plane, the center of gravity of the golf ball is substantially within said striking plane.

* * * * *